United States Patent [19]

Wittman et al.

[11] 4,394,911

[45] Jul. 26, 1983

[54] HEAVY DUTY CRANE

[75] Inventors: Leroy L. Wittman, Marion; Lyle B. Jensen, Cedar Rapids, both of Iowa

[73] Assignee: FMC Corporation, Chicago, Ill.

[21] Appl. No.: 138,461

[22] Filed: Apr. 8, 1980

[51] Int. Cl.[3] ..... B66C 23/72

[52] U.S. Cl. ..... 212/189; 212/253

[58] Field of Search ..... 212/189, 182, 176, 180, 212/179, 195, 253, 245-248, 226; 180/9.3, 9.28, 209

[56] References Cited

U.S. PATENT DOCUMENTS

| | | | |
|---|---|---|---|
| 1,241,830 | 10/1917 | Dickinson | 212/189 |
| 1,627,249 | 5/1927 | Page | 212/189 X |
| 2,139,960 | 12/1938 | Kauffman | 212/69 |
| 2,311,304 | 2/1943 | Lehti | 180/9.3 X |
| 3,460,691 | 8/1969 | Wieger | 180/9.3 X |
| 3,485,383 | 12/1969 | Beduhn | 212/48 |
| 3,528,675 | 9/1970 | Brown | 212/189 X |
| 3,868,022 | 2/1975 | Greenlay | 212/8 R |
| 3,878,944 | 4/1975 | Beduhn et al. | 212/145 |
| 3,955,684 | 5/1976 | Novotny | 212/48 |
| 4,042,115 | 8/1977 | Beduhn et al. | 212/48 |
| 4,053,060 | 10/1977 | Wilson | 212/195 X |
| 4,196,816 | 4/1980 | Dvorsky et al. | 212/49 |

FOREIGN PATENT DOCUMENTS

| | | | |
|---|---|---|---|
| 1185353 | 9/1965 | Fed. Rep. of Germany . | |
| 2554910 | 6/1977 | Fed. Rep. of Germany | 212/179 |

*Primary Examiner*—Robert J. Spar

*Assistant Examiner*—Terrance L. Siemens

*Attorney, Agent, or Firm*—A. J. Moore; R. C. Kamp; R. B. Megley

[57] ABSTRACT

Several embodiments of a crane are described and require a minimum of set up and strip down time. Each embodiment includes auxiliary frame means that is slightly wider in outside dimension than the tracks for supporting the main boom and gantry at its forward end, and supporting counterweights at its rear end with rollers on both ends permitting rotation of the auxiliary frame and vertically movable components supported thereon about a vertical axis. The rollers rest upon a horizontal steel ring supported by the ground during working of the crane, and the auxiliary frame and vertically movable components operatively connected thereto are moved upwardly to provide adequate road clearance when it is desired to move the vehicle from one site to the next. In one embodiment the ring is an inexpensive thin steel ring secured to a previously constructed concrete foundation and permits the relatively narrow vehicle to be driven over a portion of the ring onto and off of each preconstructed foundation. In the other embodiments, the ring is a full depth steel ring which is a vertically movable mobile component of the crane and is elevated with the auxiliary frame for transportation with the vehicle from one site to the next site. The full depth ring may either be provided with foldable side wings to permit movement along a narrow path or may remain in its full width attitude if travel space is not a problem.

55 Claims, 20 Drawing Figures

FIG_3
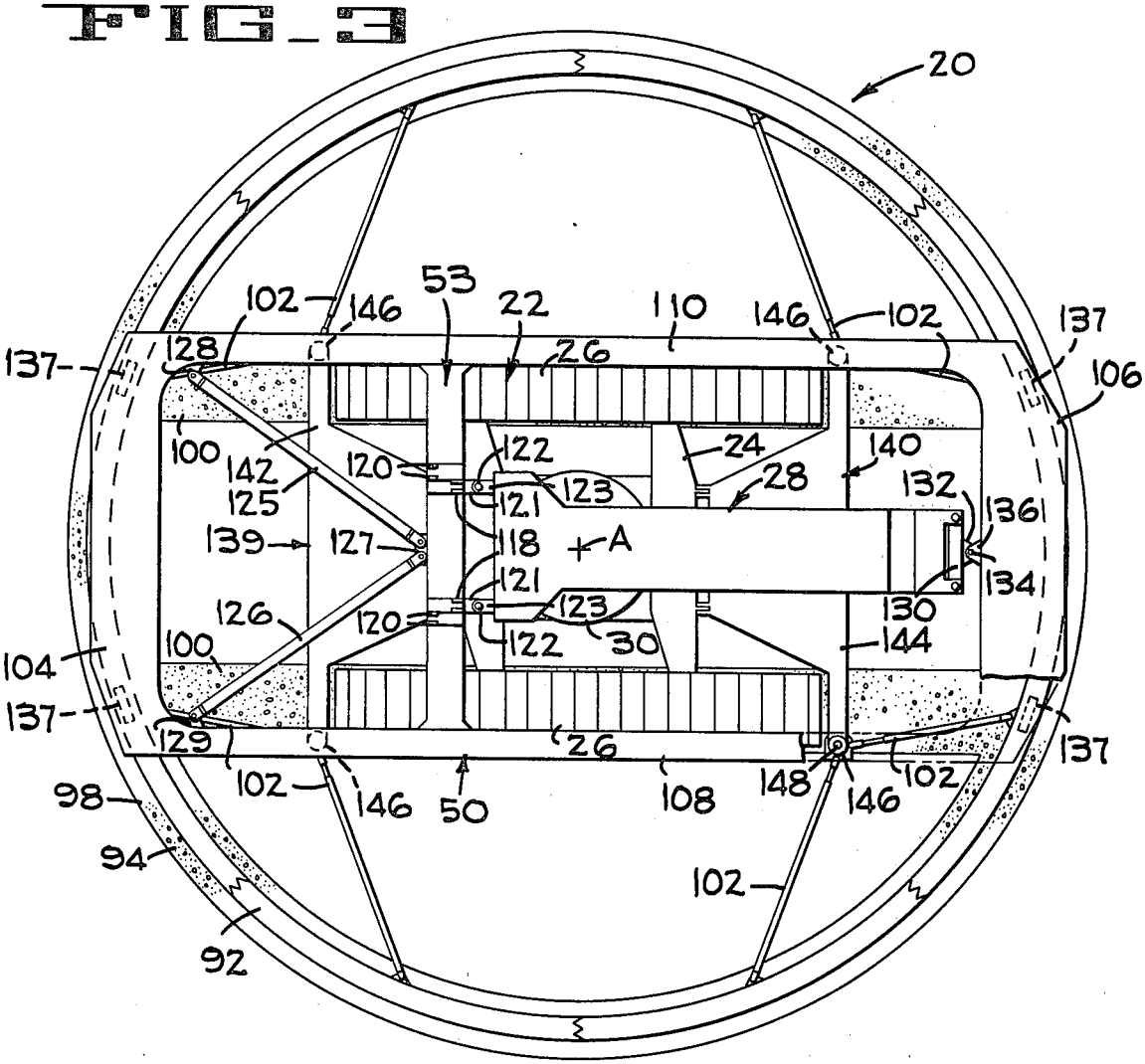
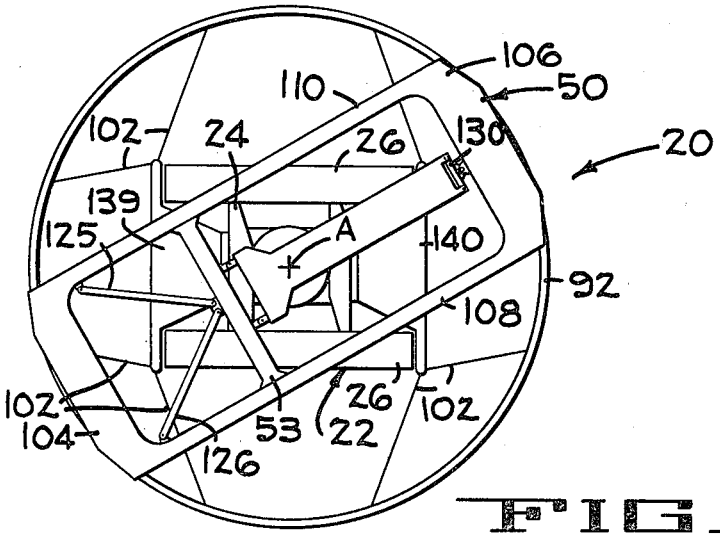
FIG_4

FIG_8A
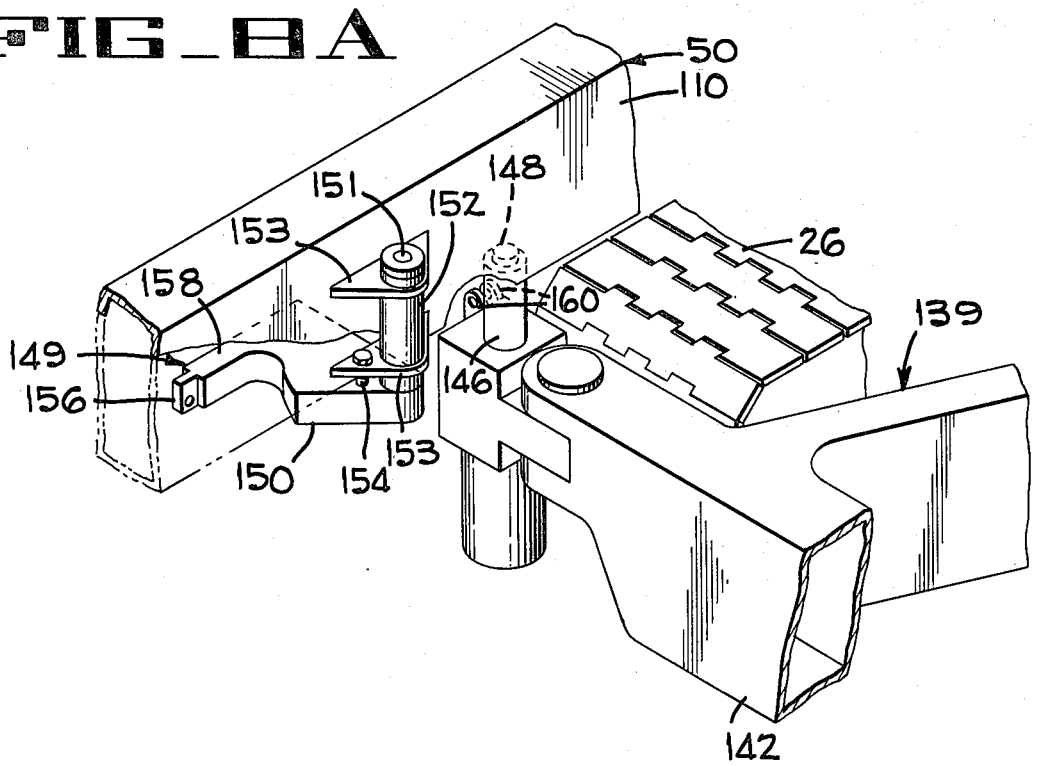
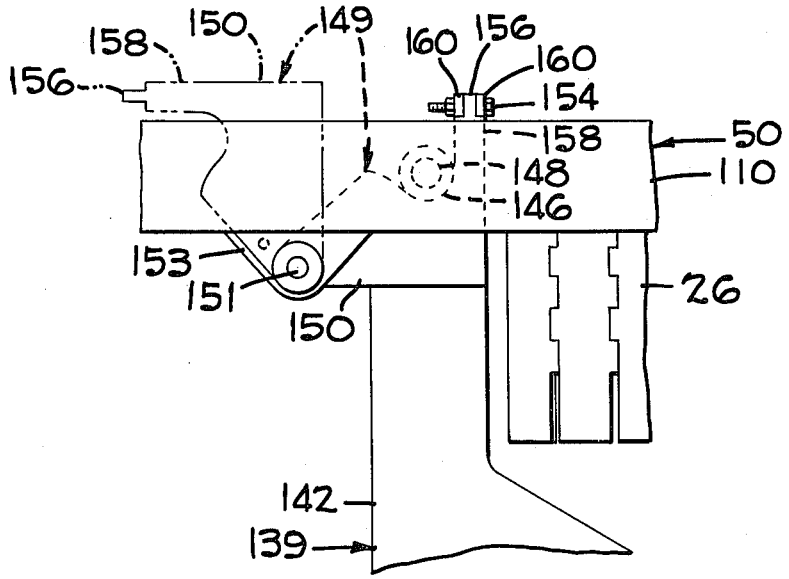
FIG_8B

FIG_11
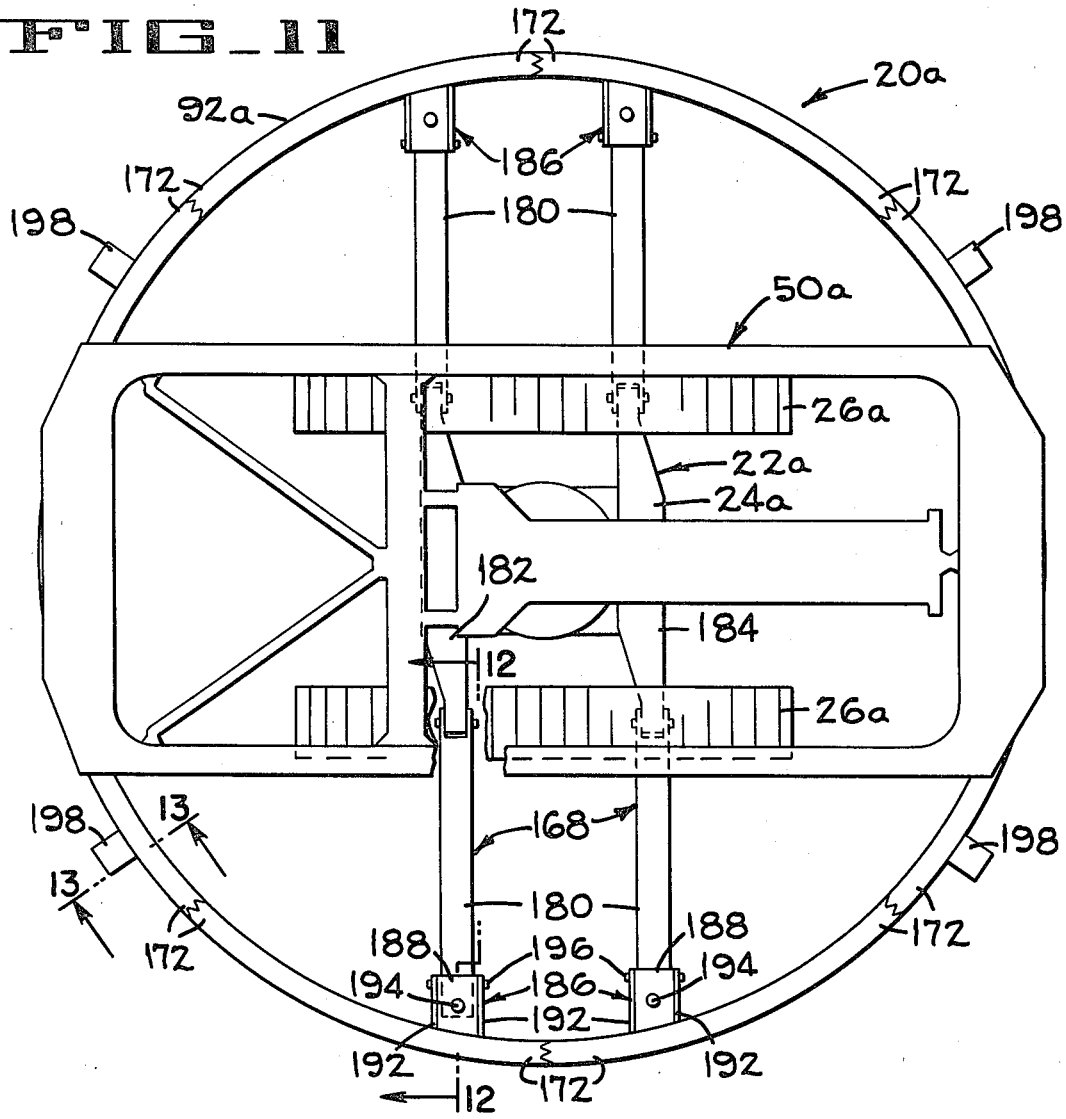
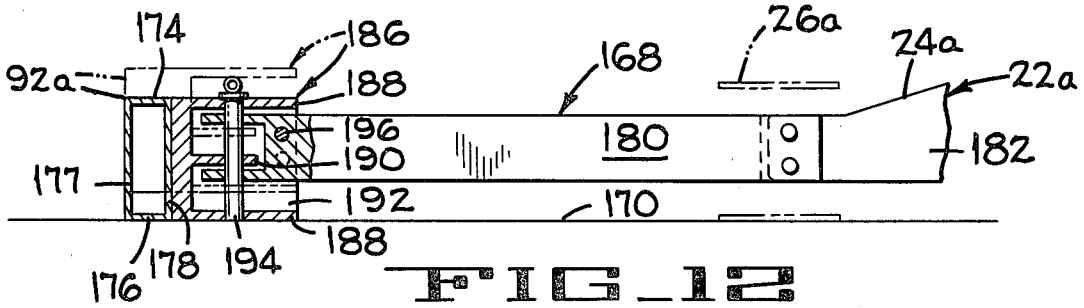
FIG_12
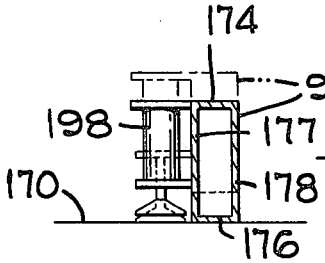
FIG_13

FIG_14
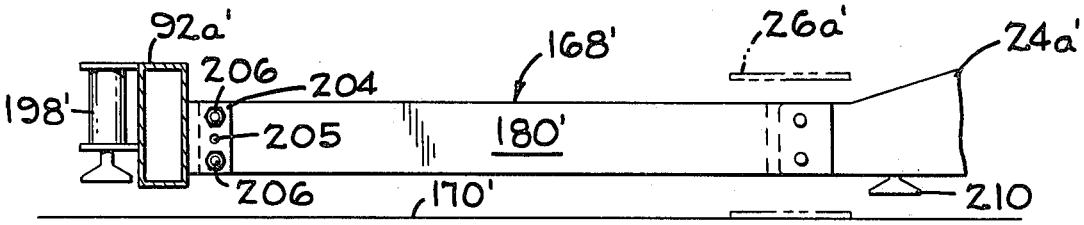
FIG_15
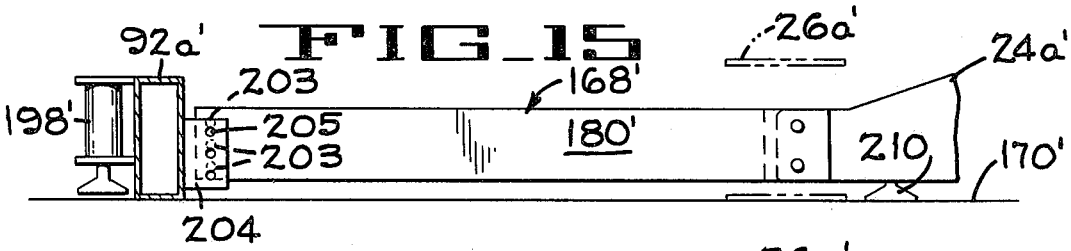
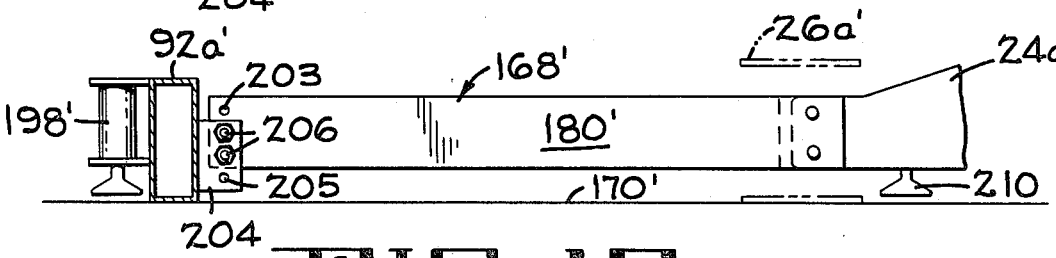
FIG_16
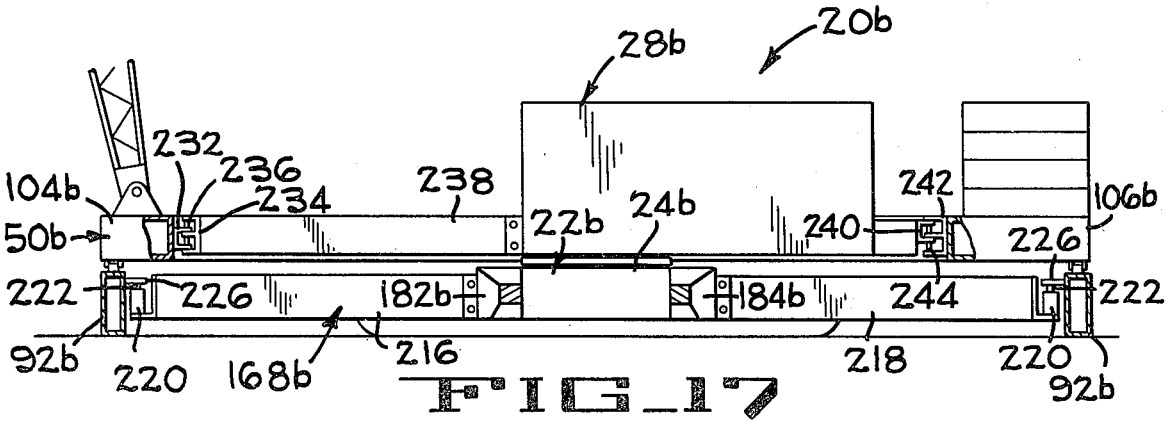
FIG_17

HEAVY DUTY CRANE

BACKGROUND OF THE INVENTION

1. Field of the Invention

The present invention relates to cranes and more particularly relates to attachments for modifying a normal duty crane to a heavy duty crane to provide a maximum diameter support base at minimum cost while at the same time minimizing the time required for set up and strip down.

2. Description of Prior Art

It is well known in the art to modify a standard crane into a heavy duty crane by providing a large diameter load supporting ring which reduces the load applied on the bearings between the upper works and the lower works. However, these prior art cranes are unnecessarily heavy and expensive, and require very wide paths for movement from place to place if the load supporting ring is to remain assembled on the machine. Many of these prior art heavy duty cranes require considerable set up and strip down time when operating at and moving between several working sites.

One prior art heavy duty crane is disclosed in assignees' United States Dvorsky et al Patent Appln. Ser. No. 847,639 (now U.S. Pat. No. 4,196,816 dated Apr. 8, 1980) which operates quite satisfactorily but requires considerable set up and strip down time at each site, and also requires a path wide enough to accommodate a large diameter full depth ring when moving from site to site.

The Dvorsky et al crane includes an auxiliary frame that is supported by a ring and engaged by the upper works of the crane for rotation therewith on the ring. Rollers on the front and rear ends of the auxiliary frame ride along the upper surface of the ring, which is full depth. A plurality of vertically adjustable standards support the ring in horizontal operative position. It will be appreciated that considerable time and manual effort is required to set up, and after the work has been completed at a particular site, to strip down the crane so that it can be moved from one site to another site. The strip down procedure involves operating the four hydraulic cylinders to lift each of the adjustable standards above the ground, and then manually screwing each standard up a sufficient distance to provide road clearance prior to lowering the tracks in crane supporting position on the ground. At this time the ring, standards, and the other components are supported by the lower works.

In addition to the above operations, the strip down procedure requires using another smaller auxiliary crane to remove a sufficient amount of the counterweights from the rear end of the auxiliary frame to balance the weight of the boom and gantry acting on the forward end of the auxiliary frame. It will be appreciated that this weight balancing procedure must be performed by all of the heavy duty cranes, including the crane claimed herein, before the cranes can be safely moved to another site.

United States Beduhn et al U.S. Pat. No. 3,878,944 which issued on Apr. 22, 1975 also discloses a mobile crane which includes a large diameter ring that is secured to the lower body or works of the crane by beams parallel to and externally of the crawler assembly of the vehicle. The crane includes an upper works rotatable about a vertical axis concentric with the ring, with a boom carrier pivoted thereto for pivotally supporting the lower ends of the boom and mast above the forward portion of the ring. A counterweight carrier is also pivoted for vertical movement to the upper works for supporting counterweights above and outwardly of the rear end of the ring. Rollers on the boom carrier and counterweight carrier engage the ring to permit rotation of the carriers and parts supported thereon around the ring. The crane with the large diameter ring supported thereon is driven to its operational site and then hydraulic jacks on the ends of the ring supporting beams are lowered to lift and level the ring. Thereafter, a plurality of manual jacks on the ends of short beams that are pivoted to the vehicle frame are lowered to support the ring in its horizontal position. The crane, therefore, carries the heavy, large diameter ring from site to site thereby requiring a wide path between sites in order to accommodate the large diameter ring. Considerable time is required for set up and strip down as compared to the heavy duty cranes of the subject invention.

United States Beduhn U.S. Pat. No. 3,485,383 which issued on Dec. 23, 1969 discloses a self-propelled crane with a large diameter supporting ring rigidly secured to the lower works of the crane, and a boom carrier pivoted to the upper works and supported on the ring by rollers. The upper works is mounted for pivotal movement about a vertical axis concentric with the ring, and includes a conventional counterweight on its rear end. An auxiliary counterweight behind the conventional counterweight is provided with rollers for support on the rear portion of the ring. Jacks are provided for initially supporting and leveling the ring at an operation site; and thereafter wooden blocks, hydraulic jacks or the like are used to support the ring from the ground. This crane therefore requires considerable set up and strip down time for filling the gap between the ring and the ground with planks or the like. Also, the large diameter ring requires that the path between operation sites be quite wide unless the ring itself is dismantled from the crane prior to moving the crane to another site.

German Pat. No. 1,185,353 which issued on Sept. 9, 1965 discloses a mobile crane having lower works, and upper works mounted thereon for pivotal movement about a vertical axis. A boom and mast supporting carriage is hinged to the forward portion of the upper works and includes rollers which ride on a large diameter ring rigidly secured to the lower works. Counterweights at the rear of the upper works are pivotally supported for vertical movement by arms which are pivoted near the forward end of the boom carriage and includes intermediate rollers which ride along a small diameter ring concentric with the vertical axis. The diameter of the ring thus determines the minimum width of the path required to move the crane from site to site, and considerable set up and strip down time is required to fill the gap between the ground and the ring to support the ring in a horizontal operative position.

United States Kauffman U.S. Pat. No. 2,139,960 which issued on Dec. 13, 1938 discloses a crane which has a large diameter ring assembled around its base at a work site. The ring is supported by a plurality of bolsters and cross beams and is centered relative to the vertical axis of the crane by a plurality of adjustable spokes. The rear ends of struts support some of the load applied and are connected to the mast, and the rear ends of side bars are pivoted to the cab. The forward ends of the struts and side bars are supported by pairs of wheels for rotation along the ring during normal operation of the crane. However, the rear or counterweight portion of the crane is not supported by the ring during normal operation.

When it is desired to move the Kauffman crane to another site, the bolsters and cross beams must be removed, and the ring may be supported on the crane chassis by grapples having rollers thereon that are pivoted into ring supporting position below an annular flange on the ring. The rollers allow the cab to be rotated relative to the ring when the crane is being moved from place to place.

SUMMARY OF THE INVENTION

In accordance with the first embodiment of the present invention, it is recognized that soil conditions at the sites of operation of heavy duty cranes differ considerably in their abilities to support the very heavy weights lifted by the cranes. Accordingly, concrete foundations in the form of rings or slabs of sufficient depth and diameter to directly support large diameter steel rings are engineered and layed at the operating site prior to moving the movable portion of the crane assembly onto the site. Each steel ring is a relatively thin, inexpensive ring made from a plurality of plates that are rigidly connected together and to provide a hard smooth substantially horizontal upper surface.

The mobile portion of the crane is then set up by driving it over the metal ring onto the slab. The axis of rotation of the upper works of the crane is substantially centered relative to the ring and held in centered position by struts connecting the ring to the lower works. A vertically movable auxiliary frame which is long and narrow is connected to the upper works for rotation therewith. One end of the auxiliary frame pivotally supports the lower end of the boom and gantry plus the article being lifted by the crane, while the other end of the frame supports a sufficient number of counterweights to substantially balance the loads acting on the auxiliary frame. Rollers on opposite end portions of the frame are supported by and rotate along the large diameter steel ring when the crane is operating thus applying substantially all of the weight acting on the crane during operation directly to the ground through the steel plate and concrete foundation thereby relieving the weight on the bearing between the upper and lower works.

When it is desired to move the mobile portion of the crane from one site to another, hydraulic jacks operatively connected between the chassis of the lower works and the auxiliary frame lift the frame off the ring after the load on the crane is first balanced by removing some of the counterweight from the rear end of the frame by means of a small auxiliary crane.

Thus, in the first embodiment of the invention the thin, inexpensive ring is not a mobile portion of the vehicle but is left at the construction site when the heavy duty crane is no longer needed at the site. It will be understood that the ring may be dismantled and moved separately from the crane. Therefore the heavy duty crane is in no way encumbered by a large diameter ring, which ring in the preferred embodiment is about 70 feet (21.5 meters) in diameter. The crane requires only about a 30 foot wide path when moving between the two concrete foundations and two steel rings thereon at two construction sites around a building or the like.

Strip down operation prior to movement to the next site merely involves removing some of the counterweights, removing the ring centering struts, operating the hydraulic jacks to raise the auxiliary frame, and then driving the heavy duty crane off the site.

A second embodiment of the invention is similar to the first embodiment except that a full depth ring, rather than the thin ring of the first embodiment, is used. The full depth ring is attached to the chassis of the crane and thus forms a mobile portion of the crane. When the crane is in operation at a working site, the full depth ring is supported on a foundation which may be less sturdy than the thick concrete foundation that supports the thin ring of the first embodiment. The foundation may be formed of relatively thin concrete, bolsters and cross beams resting on the ground, or a combination of the above. When the crane is to be moved from site to site, hydraulic jacks are provided to lift the auxiliary frame and the ring a sufficient distance above the ground to provide adequate road clearance.

A third embodiment of the invention is similar to the second embodiment except that the full depth ring is connected to hydraulic jacks interposed between the ring and the outer ends of beams that are rigidly secured to the chassis. Also, the auxiliary frame comprises a vertically movable boom foot frame and a vertically movable counterweight frame slidably connected to the outer ends of beams that define a portion of the upper works of the crane.

A fourth embodiment of the heavy duty crane is similar to the second or third embodiment except that side portions of the ring extending tranversely of the vehicle are hinged to the remaining portions of the ring so that the transverse portions or wings can be pivoted upwardly from a horizontal working position into a vertical transport position. When in the transport position latch means are provided for locking the wings in the vertical position thereby permitting the crane to be driven along narrow paths as compared to the path required by the second or third embodiments when the ring remains in a horizontal plane.

BRIEF DESCRIPTION OF THE DRAWINGS

FIG. 3 is a diagrammatic plan view taken substantially along lines 3—3 of FIG. 1 illustrating the upper works, lower works, and auxiliary frame relative to the ring.

FIG. 4 is a diagrammatic plan view similar to FIG. 3 but taken at a smaller scale and illustrating the auxiliary frame and upper works rotated to a different position relative to the lower works.

FIG. 8A is a perspective view illustrating one of four locking mechanisms for positively locking the auxiliary frame to the chassis when the frame is in transport position.

FIG. 8B is a plan view illustrating the locking mechanism in an inoperative and an operative locking position.

FIG. 9 is a perspective view at a smaller scale of the front and rear travel support frames, with portions of two struts connected to the rear frame.

FIG. 11 is a diagrammatic horizontal section taken along lines 11—11 of FIG. 10 illustrating the structure for attaching the ring to the chassis of the crane.

FIG. 12 is an enlarged section taken along lines 12—12 of FIG. 11, illustrating one of the ring supporting mechanisms in solid lines when in its operative position and in dotted lines when in its transport position.

FIG. 13 is an enlarged section taken along lines 13—13 of FIG. 11 illustrating one of the ring elevating hydraulic jacks with the ring being shown in its lowered operative position in solid lines and in its transport position in dotted lines.

FIGS. 14–16 are sections taken along a plane similar to the plane of FIG. 12 but illustrating a modified ring supporting mechanism in transport position, in an intermediate chassis leveling position, and in crane working position, respectively.

FIG. 17 is a diagrammatic longitudinal side elevation with parts in section illustrating a third embodiment of a ring supporting mechanism and a different type of auxiliary frame with the mechanism and frame being shown in operative working position.

DESCRIPTION OF THE PREFERRED EMBODIMENT

Figure 1:
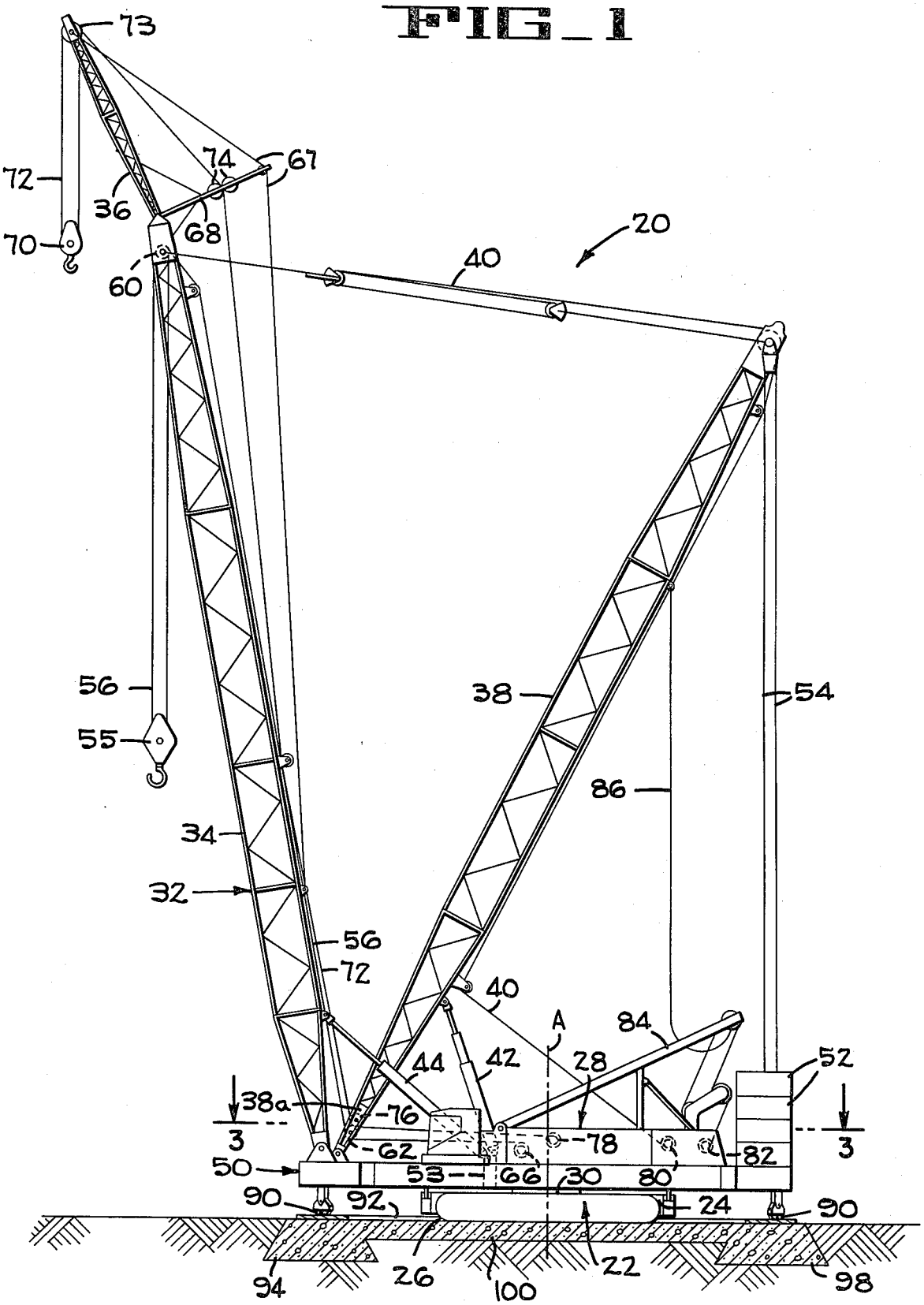
FIG. 1 is a diagrammatic side elevation of the first embodiment of the heavy duty crane of the present invention, the concrete foundation and thin steel ring being shown in longitudinal section.

The heavy duty crane 20 (FIGS. 1 and 2) of the present invention includes a lower works 22 which has a chassis 24 and ground engaging propelling members in the form of crawler tracks 26. The lower works 22 supports an upper works 28 for powered rotation about a vertical axis A with a relatively small diameter bearing 30 disposed therebetween. The upper works 28 carries a prime mover (not shown) which is under the control of an operator and provides power for the tracks 26, for rotating the upper works 28, and for a hydraulic system. The hydraulic system provides power for several hydraulic components of the machine and will be described in more detail later. Since the specific features of the components carried by the upper works and the features of the superstructure are not critical to the subject matter claimed herein, these well known components will be referred to as a superstructure and rigging assembly 32 (FIG. 1).

In the first embodiment of the heavy duty crane 20 illustrated in FIGS. 1–9, the superstructure and rigging assembly 32 includes a main boom 34, a jib boom 36 pivoted to the top of the main boom, a gantry 38, reeving 40 for connecting the upper end of the main boom 34 to the upper end of the gantry 38, a telescopic gantry stop 42 for retaining the gantry in the illustrated position, and a telescopic boom stop 44 for limiting the rearward pivotal movement of the main boom 34.

In a standard duty crane (not the heavy duty crane of the present invention) the superstructure and rigging assembly 32, and a standard counterweight 46 (FIGS. 2, 5 and 6) are mounted on the upper works 28 with all of the weight which acts on the upper works being transmitted through the bearing 30 to the lower works which is supported on the ground by tracks 26. A standard duty crane having substantially the same size components as used in the heavy duty crane of the present invention is classified in the 400 ton ($3.63\times105$ kg) class whereas the heavy duty crane of the present invention is classified in the 700 ton ($6.35\times105$ kg) class.

As will be described in more detail hereinafter, the heavy duty crane 20 of the first embodiment of the present invention includes the generally rectangular auxiliary frame 50 that is connected to the upper works 28 of the crane 20 for rotation therewith and for rectilinear vertical movement between a working position (FIGS. 1 and 5), at which time the auxiliary frame is rotatably supported at its forward and rear ends by the ground (not through the lower works 22), and a raised transport position at which time the frame 50 is supported on the chassis 24 of the lower works 22.

The lower ends of the main boom 34 (FIG. 5) and gantry 38 are pivotally connected to the front end of the auxiliary frame 50; and a multi-piece auxiliary counterweight 52, as well as the standard counterweight 46, is supported on the rear end of the auxiliary frame 50 and provides a counterweight load of about one million pounds when the crane is handling very heavy loads. The lower end of the gantry stop 42 (FIGS. 1, 2 and 15) and boom stop 44 are pivotally connected to a swing beam 53 that is rigidly secured to and forms a portion of the auxiliary frame 50. The gantry is held firmly against its stop by pendants 54 which are connected to the auxiliary frame 50 between the counterweights 52.

Having reference to FIG. 1, the heavy article (not shown) to be carried by the crane is connected to a block 55 supported by a cable 56 that has one end secured to the top of the main boom 34. The cable is trained through the block 55, over a sheave 60 journaled on the upper end of the main boom 34, below a sheave 62 journaled on a gantry base 38*a*, and around the drum of a first hoist 66 on the upper works 28 for selectively raising and lowering the article.

The jib boom 36 is held at the desired angle by pendant cable 67 and a jib mast 68. A jib block 70 and its load (not shown) are raised or lowered by a cable 72 that has one end connected to the top of the jib boom 36 and is trained through the jib block 70, over a sheave 73 journaled on the upper end of a jib mast 36, between sheaves 74 journaled on the jib mast 68, under a sheave 76 journaled on the gantry base 38*a* and around the drum of a second hoist 78 on the upper works 28.

The main boom 34 is pivoted forwardly from the illustrated position (FIG. 1) by the reeving 40 which has its lower end connected to the hydraulically driven drum of a third winch 80 on the upper work 28. A fourth winch 82 and a live mast 84 on the upper works are operable through a cable 86 to raise the gantry 38 to its illustrated working position, or to control the lowering of the gantry to a horizontal position when the crane is to be broken down for long distance transportation.

All of the above described components of the superstructure and rigging assembly 32 are well known in the art and have been described herein only to provide a complete disclosure of the heavy duty crane 20. It will be understood, however, that the auxiliary frame 50 and the manner of supporting the different components of the superstructure and rigging assembly 32 on the auxiliary frame are new and will be described below.

In accordance with the first embodiment of the invention as illustrated in FIGS. 1–9, the heavy duty crane 20 is provided with the auxiliary frame 50 which supports the weight of most of the above described superstructure and rigging assembly 32 plus a heavy article or load (not shown) carried thereby on its front end, while the counterweights 52 and 46 are carried on the rear end of the auxiliary frame. The auxiliary frame 50 is supported for a substantial amount of vertical movement relative to the upper works for permitting rollers or wheels 90 carried by the frame 50 to be raised a sufficient distance above ground level for providing road clearance, thereby permitting the crane to be driven from site to site; and to be lowered into contact with the upper hard, rigid surface of a bed which, as illustrated, includes a large diameter thin steel ring 92 that is at substantially the same level as the lower run of the tracks 26 of the crane during load carrying operations of the crane. The rollers may, instead, be mounted on or in the bed, or, more specifically, on or in the ring 92, but we prefer to mount the rollers on the frame as described above and shown in the drawings.

As indicated in FIGS. 1–3 and 5, the bed as illustrated, also includes a concrete foundation 94 which is poured at each of a plurality of working sites positioned around a building or the like to be constructed, with the upper surface of each foundation being at substantially the ground level. The concrete foundation will vary in accordance with the load carrying capacity of the soil at the site. The foundation may be in the form of a thick annular concrete ring 98 for supporting the steel ring 92 and may also include a pair of parallel concrete track supports 100 inside of and connecting with the ring 98 (shown in FIGS. 2 and 3) for supporting the tracks 26 of the crane. Another suitable foundation is a circular concrete pad having a circular periphery of sufficient depth to support the ring 92 and intended crane load at the working site.

The thin steel ring 92 is then laid on the concrete foundation either before or after the mobile portion of the crane has been driven over the ring into operative position with its central vertical axis A being substantially concentric with the axis of the ring 92. It will be understood that the concrete foundation 94 at the several operating sites are preferably constructed well before the mobile portion of the crane is to be moved onto the site.

In order to maintain the axis of the steel ring 92 and the axis A of the crane substantially concentric during operation of the crane, a plurality of adjustable struts 102 (FIGS. 3 and 5) are connected between the ring 92 and the chassis 24 of the lower works 22.

As best shown in FIGS. 2, 5, 6 and 8, the vertically movable auxiliary frame 50 includes a transversely extending boom foot frame 104, a transversely extending auxiliary counterweight frame 106, and longitudinally extending side beams 108,110 rigidly secured to the front and rear frames 104 and 106. The swing frame 53 is rigidly secured to the side beams 108,110. The lower ends of the boom 34 and gantry 38 are pivotally supported on the boom foot frame 104, and the auxiliary counterweights 52 and standard counterweights 46 are supported on the counterweight frame 106.

The standard counterweight 46 (FIGS. 5 and 6) is connected to a bracket 111 welded to the undersurface of the counterweight frame 106 by pins 112 which extend through cooperating ears 113 and 114 in the counterweight 46 and bracket 111, respectively. The rear portion of the standard counterweight 46 is heavier than its front portion, thus causing abutment surfaces 115 on the counterweight 46 to pivot upwardly against pads 116 on the bracket 111.

The structure for mounting the auxiliary frame 50 on the upper works 28 for vertical movement through a distance of about 18 inches includes the swing frame 53 (FIGS. 3, 5 and 8) which is of generally box beam construction. The swing frame 53 includes ears 118,120 projecting upward therefrom for pivotally supporting the gantry stop 42 and the telescopic boom stop 44, respectively. A pair of horiziontal guide plates 121 are welded to the swing frame and have bushed apertures therein for slidably receiving vertical pins 122. The pins 122 are secured in pairs of vertically spaced ears 123 and 124 secured to the front wall of the upper works 28. A pair of struts 125,126 are bolted between a single ear 127 on the swing frame 53 and a pair of ears 128,129 on the boom foot 104 of the auxiliary frame 50 to add rigidity to the frame.

A rear swing truss 130 is of rigid box beam construction and is rigidly secured to the upper works by suitable connectors such as bolts or the like extending through bushings 131 near the ends thereof. A U-shaped yoke 132 is rigidly secured to the rear end of the truss 130 and is slidably received on a pin 134 that is secured to spaced ears 136 that are welded to the counterweight frame 106 of the auxiliary frame 50.

It will be appreciated that the vertical spacing of the ears 123 and 124 on the front of the lower works, and the spacing of the ears on the counterweight frame 106 will permit vertical movement of the auxiliary frame through about 18 inches relative to the upper works 28 and will also cause the auxiliary frame 50 to rotate with the upper works.

Figure 5:
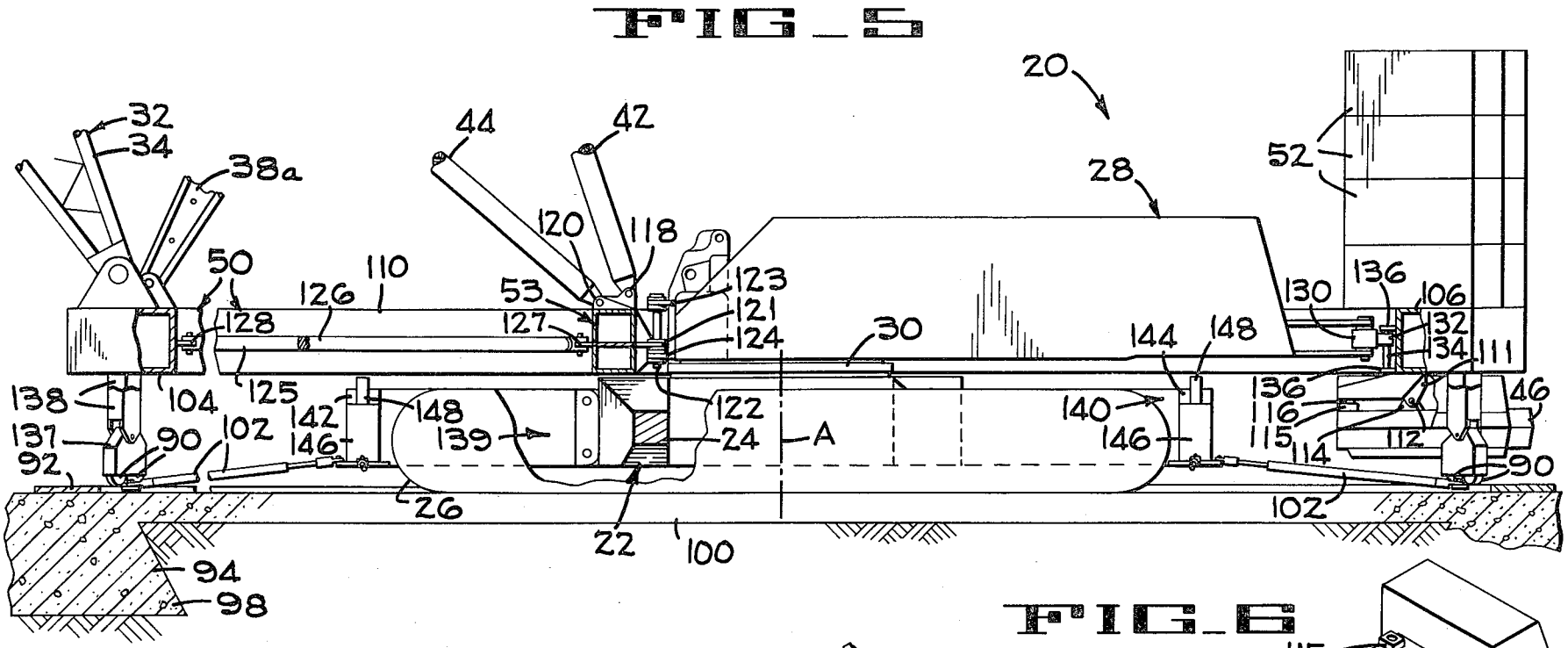
FIG. 5 is a diagrammatic side elevation of a portion of the crane illustrating the mechanism for supporting the auxiliary frame for vertical movement relative to and rotation with the upper works, certain parts being cut away and others shown in section.
Figure 6:
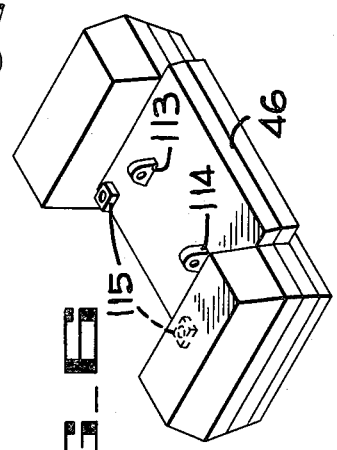
FIG. 6 is a perspective view of a standard counterweight used on both a standard frame and the heavy duty crane of the present invention.
Figures 5, 8:
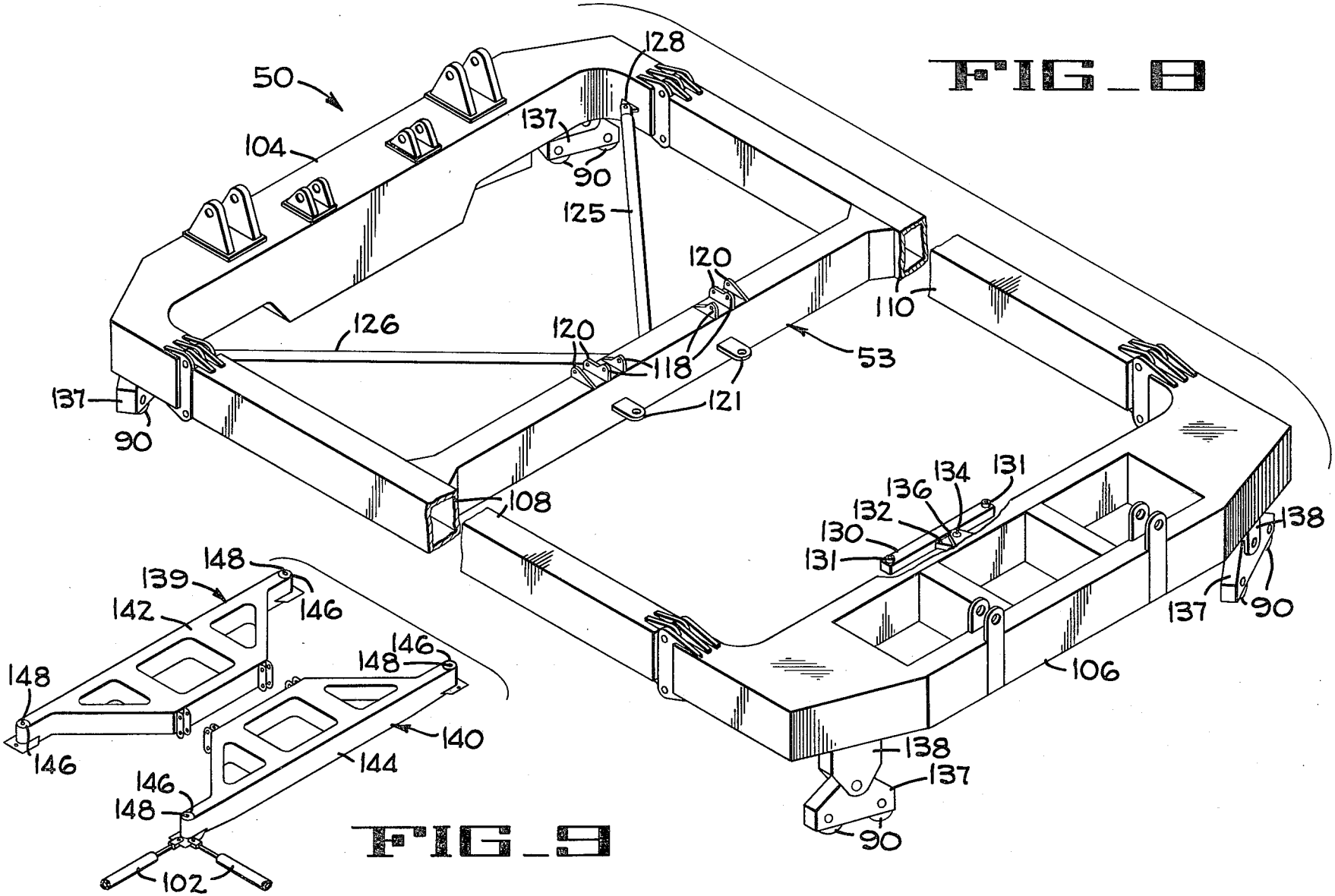
FIG. 8 is an enlarged perspective view of the auxiliary frame and components for connecting the frame to the upper works, certain portions of the frame being cut away.

The aforementioned rollers or wheels 90 which ride on the ring 92 when the crane is working are preferably mounted in pairs for rotation on pivot bars 137 (FIGS. 5 and 8). The pivot bars 137 are pivotally connected to legs 138 extending downwardly from the boom frame 104 and from the counterweight frame 106 as best shown in FIGS. 2, 5 and 8.

Figure 2:
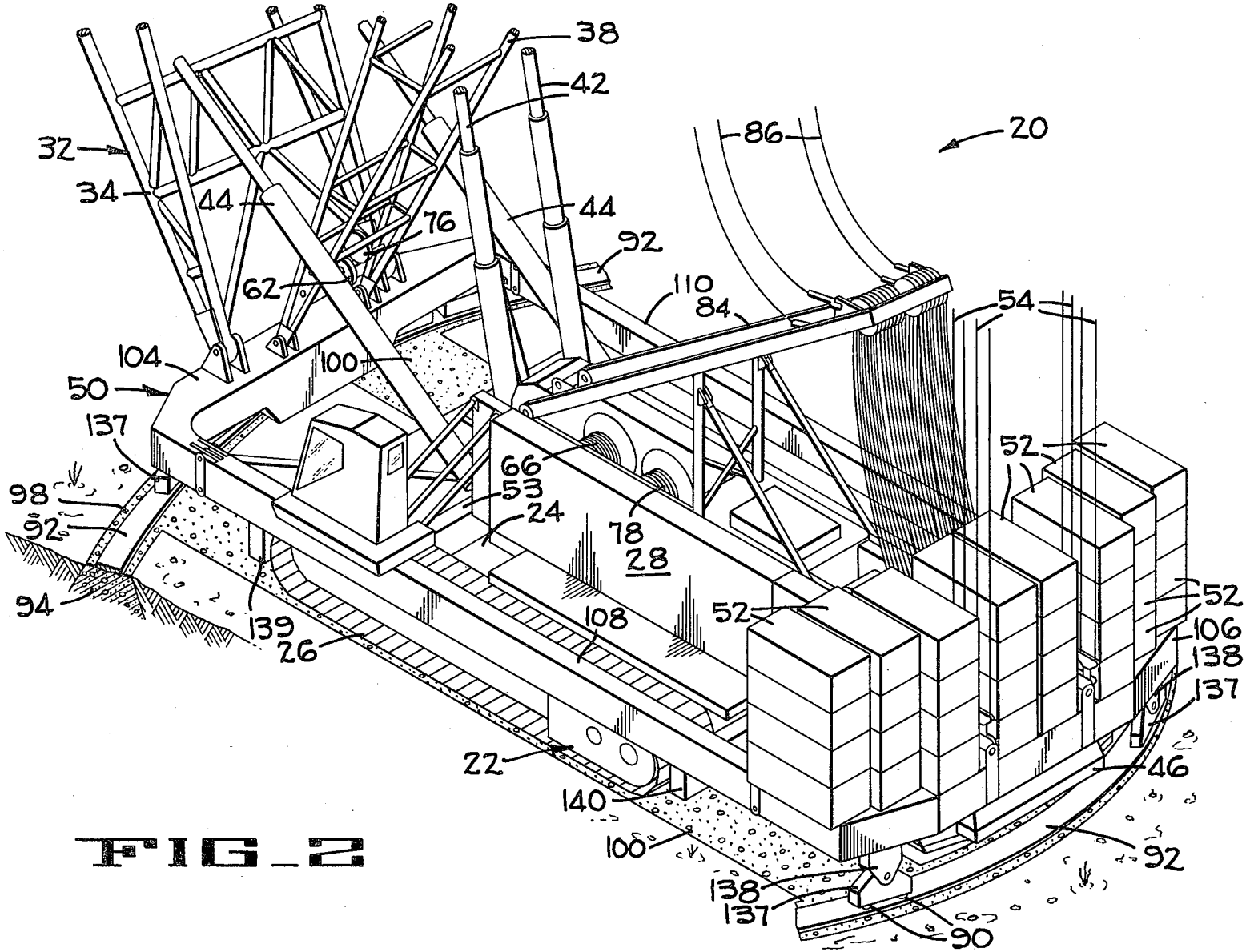
FIG. 2 is a perspective view of the heavy duty crane of FIG. 1, certain parts being cut away.
Figure 7:
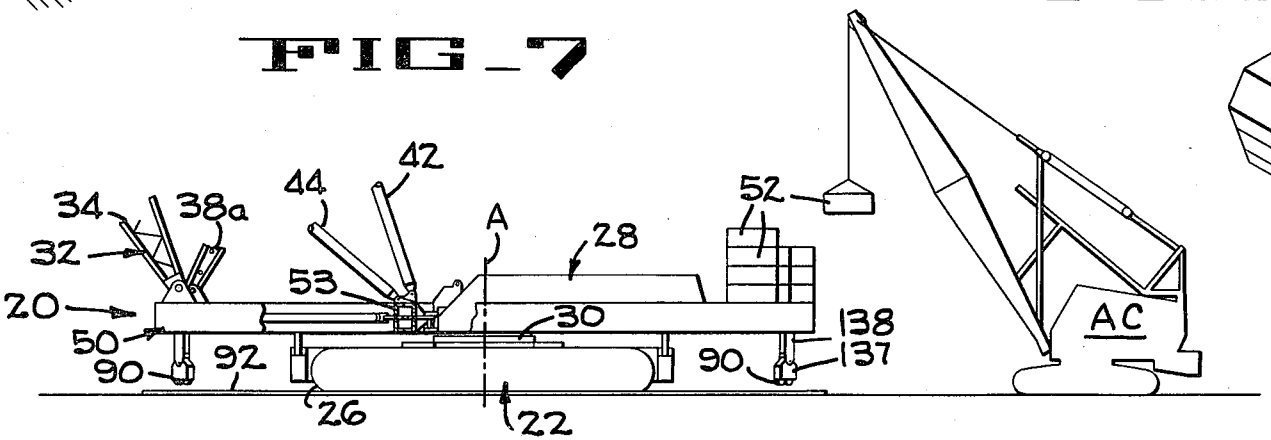
FIG. 7 is a diagrammatic side elevation illustrating the portion of the heavy duty crane in its transport position, and further illustrating an auxiliary crane which is removing counterweights from the auxiliary frame for maintaining the auxiliary frame substantially balanced about its vertical axis of rotation.

The structure for raising and lowering the auxiliary frame 50 relative to the lower works is best illustrated in FIGS. 2, 3–5, 7 and 9 and includes front and rear travel support frames 139,140 that are rigidly secured to the front and rear ends, respectively, of the chassis 24 of the lower works 22 and thus may be considered a portion of the chassis. Each travel support frame includes a transverse beam or outrigger 142,144, respectively, which extends a short distance outwardly beyond the maximum width of the tracks. In the illustrated preferred embodiment, the maximum width of the tracks is 27½ feet, while the outriggers span a width of 30 feet. Frame lifting means, which means are preferably hydraulic jacks 146 (FIGS. 3, 5 and 9) that receive power from the crane's standard hydraulic system, are rigidly secured to both ends of each outrigger 142,144. When the longitudinal axis of the auxiliary frame 50 is rotated into a position parallel with the longitudinal axes of the tracks 26 as illustrated in FIGS. 3, 5 and 7, the piston rods 148 of the jacks 146 may be actuated by an operator to lower the auxiliary frame 50 until it is supported on the steel ring 92 by the wheels 90 as illustrated in FIG. 2; or to raise the auxiliary frame 50 to its transport position as illustrated in FIG. 7.

The auxiliary frame 50 is mechanically locked to the travel support frame 139,140 when in the transport position to positively prevent the auxiliary frame from inadvertently pivoting off of the travel support frames and to relieve pressure from the hydraulic jacks 146. Four locking mechanisms 149, only one mechanism being shown in FIGS. 8A and 8B, are provided to perform this function.

Each mechanism 149 is associated with one of the hydraulic jacks 146 on the associated support frame 139,140 and becomes operative after the auxiliary frame 50 has been pivoted into position to be engaged and lifted by the four jacks 146. Each locking mechanism 149 comprises a stand-off 150 secured to a shaft 151 rotatably supported in a housing 152 secured to the auxiliary frame 50 by ears 153 positioned adjacent the associated jacks when the frame is in its transport position. When in its inactive position, the stand-off 150 is latched to the auxiliary frame 50 by a connector such as a bolt or pin 154 as illustrated in FIG. 8A. In order to move the stand-off 150 into locking engagement with the adjacent end of the associated travel support frame 139,140, the four hydraulic jacks 146 are actuated to first lift the auxiliary frame 50 a sufficient distance above the associated travel support frame 139,140 to permit the stand-off to be pivoted 270° into the position illustrated in FIG. 8B. At least one apertured ear 156 is secured to the outer end of a leg 158 of the stand-off 150 and is aligned with a pair of apertured ears 160 secured to the adjacent end of the associated travel support frame 139,140. The connector 154 is then used to connect the ears 156,160 together permitting release of hydraulic pressure in the jacks 146 and positively locking the auxiliary frame 50 to the travel support frames 139,140 in transport position. It will, of course, be understood that the vertical thickness of each stand-off 150 is the same as the desired travel clearance.

In operation of the first embodiment of the heavy duty crane 20 of the present invention, one or more concrete foundations 94 are engineered and poured at at least one work site and preferably several work sites positioned around a building or the like where the heavy duty crane 20 will be needed. It will be understood that such foundations may be poured and the thin steel ring may be placed on the foundation well before the mobile portion of the crane 20 is to arrive at the working site.

When the heavy duty crane 20 is needed, it is merely driven over a portion of the ring 92 and is centered so that the axis A of rotation of the upper works 28 is substantially concentric with the axis of generation of the steel ring 92 and of the concrete ring 94.

Prior to driving the mobile portion of the crane onto the working site, the auxiliary frame 50 and structure supported thereon is raised to the transport position illustrated in FIG. 7 by the hydraulic jacks 146. When the crane is properly centered with respect to the ring 92, the adjustable struts 102 (FIGS. 3 and 5) are connected between the ring 92 and the chassis 24 of the lower works 22. The auxiliary frame 50 is then lowered by the hydraulic jacks 146 until the rollers 90 engage the steel ring 92 thus supporting the frame 50 on the ground through the steel ring 92 and concrete foundation 94, rather than through the bearing 30 and lower works 22. It will be appreciated, however, that the weight of the lower works 22 aided by the struts which tie the lower works to the steel ring 92 provide sufficient frictional resistance to prevent rotation of the lower works 22 and ring 92 when the upper works 28, auxiliary frame 50 and loads supported thereon are rotated about the vertical axis A. Prior to lifting a heavy article with the crane, for example an article weighing 700 tons, a sufficient amount of counterweight is loaded on the rear end of the auxiliary frame 50 by a small auxiliary crane AC (FIG. 7). Upon completing the above set up procedures, the heavy duty crane 20 is ready for operation.

After work has been completed at the working site and it is desired to drive the crane to another previously prepared site, the strip-down procedure merely involves removing a sufficient number of counterweights with the aid of the auxiliary crane AC (FIG. 7), rotating the auxiliary frame 50 until its longitudinal axis is parallel to the axes of the tracks 26, actuating the hydraulic jacks 146 to raise the auxiliary frame 50 to its transport position as illustrated in FIG. 7, pivoting and securing the four locking mechanisms 149 in locked position, disconnecting the struts 102 (FIG. 3) and then driving the mobile portion of the crane 20 over the ring 92 and onto the next working site. The thin steel ring 92 is relatively inexpensive, and accordingly, is either scrapped, or if desired, may be reclaimed at a later date without requiring any additional down time of the crane during the strip down procedure. If desired the ring may be dismantled and moved away from the site when work is completed and when convenient. The dismantled ring may be placed in storage or assembled at another site when desired.

An advantage of leaving the steel ring 92 at the site rather than transporting it with the mobile portions of the crane 20 to another site, is that the illustrated crane 20 with no ring attached is capable of moving along an approximately 30 foot wide path, but such crane would require approximately a 70 feet wide path if the 70 foot diameter ring 92 was included in the mobile portion of the crane and remained in extended position during transport to the other side.

A second embodiment of the heavy duty crane **20*a* (FIGS. 10–16) is quite similar to the first embodiment of the invention except for the provision of a full depth ring 92*a* and support mechanism 168 from mounting the ring to the chassis 24*a* of the lower works 22*a* of the crane 20*a*. Thus, in the second embodiment of the invention, the large diameter, full depth ring 92*a* becomes a mobile portion of the crane 20*a***.

Since many of the components of the second embodiment of the heavy duty crane **20*a* are similar or identical to those of the crane 20 of the first embodiment, parts of the crane 20*a*** that are equivalent to components of the first embodiment will not be described in detail but will be assigned numerals followed by the letter "a".

Use of the full depth ring **92*a* (FIGS. 10–14), as opposed to the thin ring 92 of the first embodiment, is appropriate when ample room is provided to move the 70 foot diameter ring from site to site. Also, use of the full depth ring has the advantage over a thin ring in that a less sturdy foundation or bed is required since a full depth ring will not bend as easily as the thin ring if not adequately supported throughout its entire circumference. However, the foundation 170 at each site must be substantially level for properly supporting the tracks 26a and ring 92a**.

Figure 10:
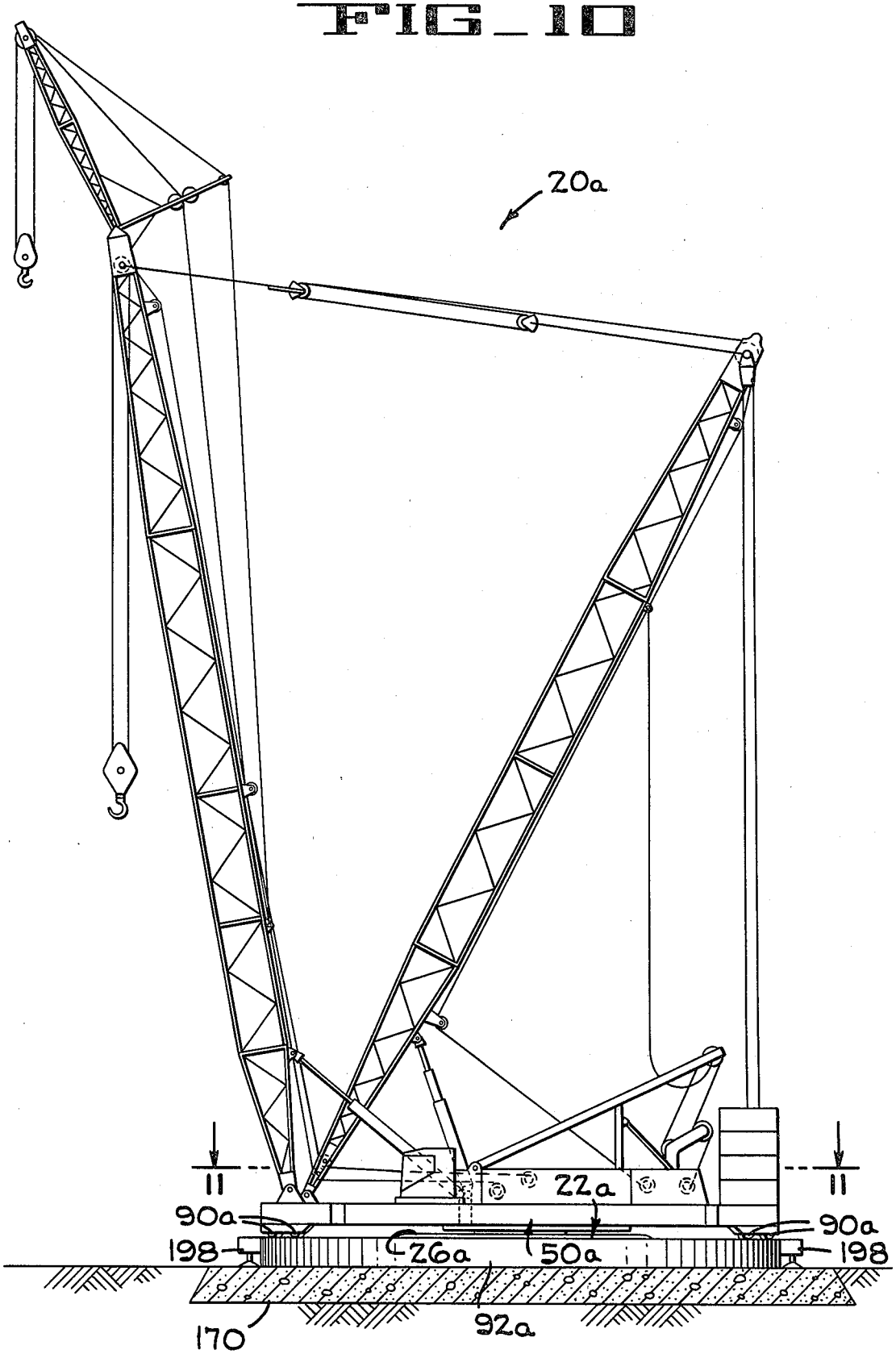
FIG. 10 is a diagrammatic side elevation similar to FIG. 1 but illustrating the heavy duty crane of the second embodiment of the invention with its full depth ring in operative position on a concrete pad.

The preferred foundation is a concrete foundation 170 as illustrated in FIG. 10, although the well known bolster and cross beam foundations, and mats or the like may also be used.

The full depth ring 92a (FIGS. 10–13) is made in a plurality of sections 172 (FIG. 11) that are bolted together. The ring 92a is of box beam construction including a top wall 174 (FIG. 12), a bottom wall 176, and side walls 177 and 178 all welded together.

The ring supporting mechanism 168 is provided for mounting the ring 92a to the chassis 24a and for moving the ring between its operative frame supporting position and its transport position. The mechanism 168 comprises four beams 180, with each beam 180 being rigidly secured to one end of an axle 182,184 of the crane 20a as by bolting. The outer end of each beam 180 (FIG. 12) is forked and projects into the open end of a bracket 186 that is welded to the ring. The bracket 186 includes upper and lower walls 188, an intermediate wall 190, and side walls 192. The intermediate wall 190 projects into the forked end of the associated beam 180. As clearly illustrated in FIG. 12, a vertical pin 194 extends through the aligned horizontal walls 188,190 of the bracket 186 and the forked end of the beam 180 for permitting vertical movement of the ring 92a from the working position illustrated in solid lines and the transport position illustrated in dotted lines. A latch pin 196 extends through a single horizontal hole in the beam 180 and an upper pair of holes in the side walls 192 of the bracket 186 when in its working position; and extends through a lower pair of holes in the side walls 192 to latch the ring 92a in its transport position with its lower surface about 18 inches above the ground.

In order to raise and lower the full depth ring 92a between its two positions, a plurality of lifting means, preferably hydraulic jacks 198 (FIGS. 11 and 13) are secured to the ring 92a and are connected to a well known hydraulic system and hydraulic controls (not shown) of the crane 20a.

Although the beams 180 have been illustrated as being connected to the axles 184 and projecting transversely of the chassis 24a, it will be understood that it is within the scope of the invention for the beams 180 to be connected to the chassis and project forwardly and rearwardly therefrom.

In operation of the heavy duty crane 20a with its full depth ring 92a connected thereto as a mobile component thereof, the crane 20a with its ring 92a raised to the dotted line transport position is driven into working position onto the operation site. Preferably, the foundation 170 at the site is a concrete pad as previously mentioned. The feet of the hydraulic jack 198 (four being illustrated) are then lowered against the foundation 170 thereby raising the ring 92a and the auxiliary frame 50a, which is supported thereon by the rollers 90a, a sufficient amount to permit the latch pins 196 to be removed. The hydraulic jacks 198 are then operated to lower the ring and auxiliary frame 50a into working position with the lower surface of the ring being supported directly on the foundation 170. The latch pins 196 are then preferably inserted in the upper holes in the side walls of the bracket 186 prior to placing the crane 20a in operation.

After work has been completed on the site, the above procedure is reversed, and upon raising and latching the ring 92a and auxiliary frame in their upper transport positions by means of the hydraulic jacks 198 and latch pins 196, the heavy duty crane 20a is driven off the foundation 170 to the next working site.

Thus, the set-up and strip down time is at a minimum when the heavy duty crane 20a of the second embodiment of the invention is supported on the concrete foundation 170 during operation. When the foundation is constructed as a mat or from bolsters and cross beams, the set up and strip down time is increased by the amount of time required to construct and remove the foundation.

It will be understood that the crane 20a of the second embodiment of the invention does not require separate operating means on the chassis to lift the auxiliary frame 50a as was required in the first embodiment of the invention sine both the ring 92a and the auxiliary frame 50a are lifted by the hydraulic jacks 198.

FIGS. 14, 15 and 16 illustrate a modified form of ring supporting mechanism 168' for use on the crane 20a. The mechanism 168' is the same as in mechanism 168 (FIGS. 11, 12 and 13) except that each beam 180' has three horizontal holes 203 in the free end thereof, which free end is slidably received for vertical movement between a pair of plates 204 (only one being shown) welded to the inner surface of the ring 92a' and having three aligned holes 205 therein. When the ring 92a' is in its transport position illustrated in FIG. 14, a pair of bolts 206 are inserted through the upper and lower sets of aligned holes 203,205 to maintain the ring 92a and auxiliary frame (not shown) rotatably supported thereon in its uppermost position.

When the ring 92a' is to be lowered into its working position on the foundation 170', the hydraulic jacks 198' (shown rotated out of normal position) on the ring 92a', and an additional hydraulic jack 210 associated with each beam 180°, are operated to permit removal of the bolts 206, and lowering of the ring 92a' onto the foundation 170' as indicated in FIG. 15. The jacks 210 are then manipulated until the bolts 206 can be inserted into the two upper pair of holes in the plates 204 and the two lower holes 203 in the associated beam 180'. As indicated in FIGS. 14 and 16, all of the jacks 198' and 210 have their feet raised when in the transport position (FIG. 14) and also when in the working position (FIG. 16).

FIG. 17 diagrammatically illustrates a third embodiment of the heavy duty crane 20b of the invention which includes a different type of ring supporting mechanism 168b and also includes a modified auxiliary frame 50b.

Parts of the third embodiment of the heavy duty crane 20b which are equivalent to the first or second embodiments will not be described in detail but will be assigned the same numerals used in these embodiments followed by the letter "b".

The mechanism 168b includes a pair of forwardly extending beams 216 (only one being shown), and a pair of rearwardly extending beams 218 (only one beam shown) rigidly secured to the chassis 24b of the lower works 22b. Ring lifting means, preferably hydraulic jacks 220, are supported on the free end of each beam 216,218 and have their piston rods 222 movable into engagement with abutment plates 226 rigidly secured to the full depth ring 92b.

The full depth ring 92b is substantially the same as that disclosed in the second embodiment except that the hydraulic jacks of the second embodiment which are attached to the ring and which bear against the foundation are omitted. Instead, the hydraulic jacks 220 perform the function of the omitted jacks and are interposed between the ring 92*b*and beams 216,218 rather than between the ring and the foundation 170*b*.

The auxiliary frame 50*b* differs from that disclosed in the first embodiment in that the boom foot frame 104*b* and the counterweight frame 106*b* are the only vertically movable portions and accordingly define the auxiliary frame. As illustrated in FIG. 17, narrow U-shaped brackets 232 (only one being shown) are slidably connected to associated reverse E-shaped brackets 234 by vertical pins 236. The E-shaped frames 234 are secured to a truss 238 that is rigidly connected to and extends forwardly of the upper works 28*b*. Similarly, narrow U-shaped brackets 240 (only one being shown) are connected to the rear end of the upper works 28*b* and are slidably connected to associated reverse E-shaped brackets 242 by vertical pins 244. The E-shaped brackets 242 are rigidly secured to the forward end of the counterweight frame 106*b*.

The operation of the third embodiment of the crane 20*b* is substantially the same as that of the second embodiment and accordingly will not be repeated herein. Although FIG. 17 illustrates the beams 216,218 of the ring supporting mechanism 168*b* extending forwardly and rearwardly, respectively, it will be understood that the beams may be connected between the axles 182*b* and 184*b* and thus extend laterally of the lower works 22*b*, if desired.

Figure 18:
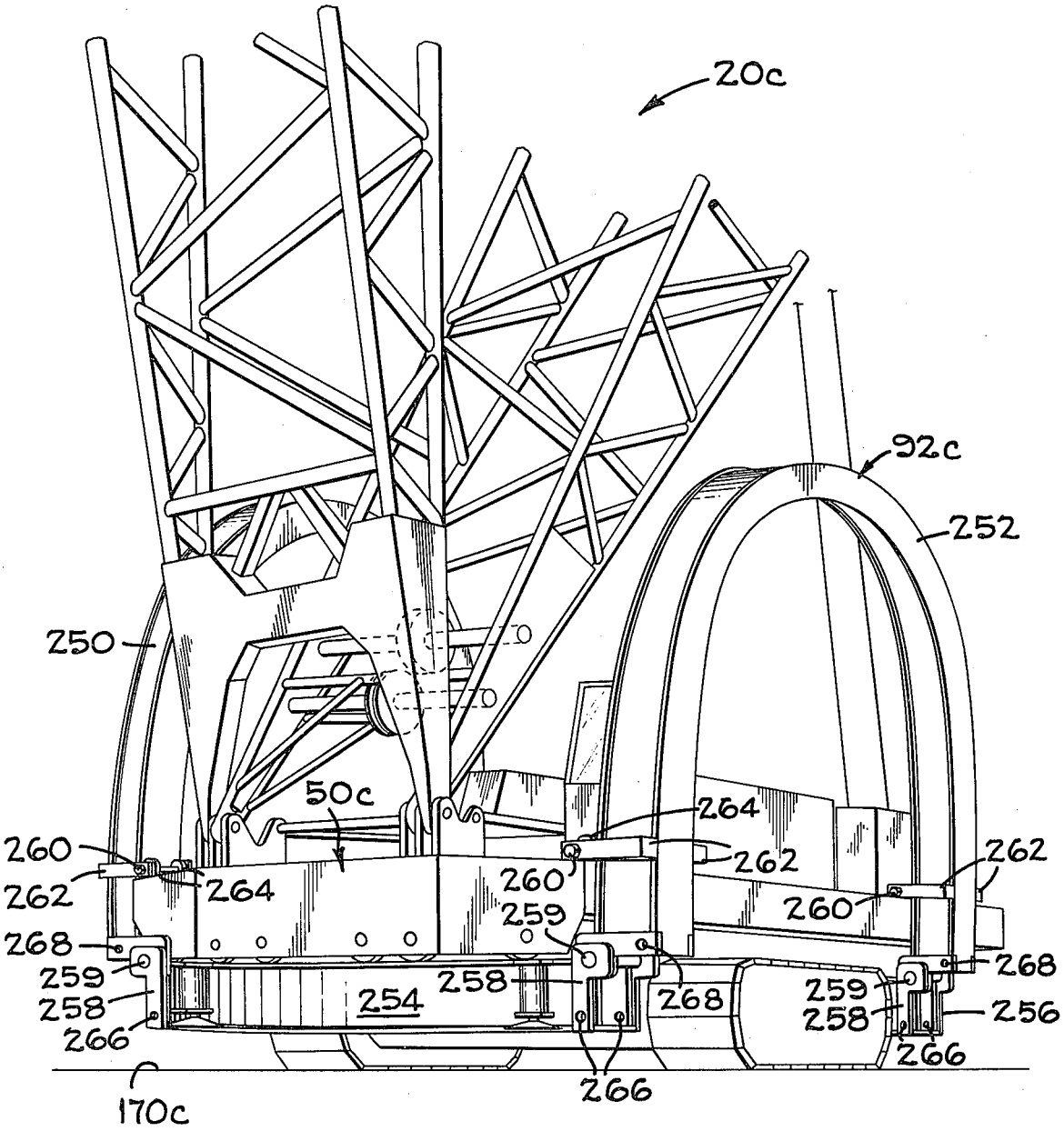
FIG. 18 is a perspective of a fourth embodiment of the invention illustrating a ring having its transverse side portions pivoted upwardly in a transport position.

The fourth embodiment of the heavy duty crane 20*c* (FIG. 18) of the present invention is substantially the same as the third embodiment 20*b*, or the second embodiment provided the beams 180' (FIG. 11) extend longitudinally of the vehicle rather than transversely thereof, except that transverse portions or wings 250,252 of the full depth ring 92*c* are pivoted to the forward and rear end portions 254,256 of the ring 92*c* by hinges 258. The four hinges 258 connect mating edges of the wings 250,252 and end portions 254,256 of the ring 20*c* as clearly illustrated in FIG. 18. When the wings 250,252 are pivoted upwardly about pivot pins 259 to the transport position as illustrated in FIG. 18, they are latched in place by bolts 260 which extend through holes in straps 262 welded to the associated wings 250,252 and holes in ears 264 welded to the auxiliary frame 50*c*.

When the wings 250,252 are to be pivoted downwardly into their horizontal working positions, the bolts 260 are removed from the holes in the straps 262 and ears 264 and are inserted in holes 266,268 in the associated hinges 258 and wings 250,252. The ring 92*c* may then be lowered onto the foundation 170*c* at the working site for rotatably supporting the auxiliary frame 60*c* as described in the other embodiments of the invention.

Since small crane such as the crane AC (FIG. 7) are present at the work projects, the small crane AC may be used to pivot the wings 250,252 (FIG. 18) between their horizontal and vertical positions.

From the foregoing description it is apparent that each of the several embodiments of the invention include auxiliary frame means which carries the boom and article on one end of the frame means and counterweights on the other end. The auxiliary frame means is connected to the upper works for rotation therewith while supported by a large diameter load supporting steel ring when the ring is supported on a foundation substantially at ground level. Means are provided to vertically move the auxiliary frame and mobile portions of the crane that are operatively connected thereto between a working position wherein the lower surface of the steel ring is supported directly upon the foundation, and a transport position wherein the crane is supported on its track and adequate road clearance is provided between the lowermost of the other mobile portions of the crane and the ground level.

In the first embodiment the steel ring is a thin inexpensive ring which is laid upon the concrete foundation at the work site at ground level so that the crane may be driven over the ring onto and off of the foundation. The thin ring of the first embodiment may be reclaimed at a later date if desired, and is not a mobile portion of the crane.

In the other embodiments of the invention the steel ring is a full depth ring that forms a mobile portion of the heavy duty crane and is carried from site to site on the crane. In these embodiments, the road clearances is the distance between the lower surface of the ring and the foundation or ground elevation when the ring is in its transportation position. In the third embodiment of the invention the boom foot frame at the front of the crane and the counterweight frame at the rear of the frame define the vertically movable auxiliary frame means; and in the fourth embodiment of the invention the transverse portions of the full depth ring are pivoted between a horizontal working position and a vertical transport position.

Although the best mode contemplated for carrying out the present invention has been herein shown and described it will be apparent that modification and variations may be made without departing from what is regarded to be the subject matter of the invention.

We claim:

1. A mobile heavy duty self propelled crane for use on a foundation at a work site having a generally horizontal load supporting surface substantially at ground level, said crane including a lower works having ground engaging transport means, an upper works including an auxiliary frame means and mobile components operatively connected thereto and mounted on said lower works for rotation about a vertical axis, a large diameter steel ring having a lower surface and an upper surface, rotatable means for supporting the auxiliary frame on said ring for rotation relative thereto; the improvement which comprises means mounting said auxiliary frame means and certain components operatively connected thereto for substantial vertical movement, jack means operatively connected to said auxiliary frame means for vertically moving said frame means and said vertically movable mobile crane components operatively connected thereto between a lowered working position wherein the auxiliary frame means is supported by said rotatable means on the upper surface of said ring while the lower surface of the ring is supported on the load supporting surface of said foundation, and a raised transport position wherein said mobile ground engaging means supports all other vertically movable components of the crane a sufficient distance above the lower surface of said ground engaging transport means to provide adequate road clearance.

2. An apparatus according to claim 1 wherein said jack means are hydraulic jacks.

3. An apparatus according to claim 1 wherein said jack means are supported between said lower works and said auxiliary frame means for selectively raising and lowering said auxiliary frame means.

4. An apparatus according to claims 1 or 3 wherein said vertically movable crane components include a boom having its lower end supported by one end of said auxiliary frame means and counterweight means supported by the other end of the frame means diametrically opposite said one end.

5. An apparatus according to claim 4 wherein said one end and said other end of said auxiliary frame means are rigidly connected together by side beams, said end portions and side beams being moved between the lower working position and the raised transport position as a unit.

6. An apparatus according to claim 1 wherein said rotatable means are a plurality of wheels rotatably connected to said auxiliary frame means, and wherein the distance between said wheels and said lower surface of said ground engaging transport means defines the road clearance when the auxiliary frame means is in its transport position.

7. An apparatus according to claim 1 wherein said ring is a thin steel ring that is laid upon the foundation when said frame means is in its lower working position, said crane being driven over a portion of said ring when entering or leaving a working site.

8. An apparatus according to claim 7 and additionally comprising strut means for tying said ring to said lower works with the axis of said ring being substantially concentric with said vertical axis of rotation.

9. An apparatus according to claim 1 wherein said ring is a full depth ring, and wherein said jack means is supported by said ring and operatively engages the foundation for raising and lowering said ring and said frame means, and additionally comprising locking means for locking said frame means to said lower works in said transport position and permitting said jack means to be raised above said foundation.

10. An apparatus according to claim 1 wherein said ring is a full depth ring and supports said auxiliary frame means thereon through said rotatable means, and additionally comprising a support for connecting said ring to said lower works, said support mechanism comprising a plurality of beams rigidly secured to said lower works and having their free ends extending outwardly to positions adjacent said ring, means for connecting said beams to said ring for vertical movement between said lower working position and said transport position, means for latching said ring to said beams at least when in said transport position, said jack means operatively connected to said ring for selectively moving said ring and said auxiliary frame means between said working and transport positions.

11. An apparatus according to claim 10 wherein said jack means are carried by said ring and operatively engage the horizontal supporting surface of the foundation when raising and lower said ring.

12. An apparatus according to claim 10 wherein said jack means are connected between said beams and said ring.

13. An apparatus according to claims 11 or 12 wherein said jack means are hydraulic jacks which receive their power from a hydraulic system included in said crane.

14. An apparatus according to claim 10 wherein said lower works includes a chassis having axles extending transversely therefrom, and wherein said beams are rigidly secured to said axles.

15. An apparatus according to claim 14 wherein said beams extend transversely outward of said chassis.

16. An apparatus according to claim 1 wherein said ring is a full depth ring and wherein said jack means is operatively connected to said ring for moving said ring and auxiliary frame means between said working and transport positions, said ring additionally including transverse wing portions, front and rear end portions, hinge means pivotally connecting said wing portions to said front and rear end portions of said ring, and latch means for latching said wing portions in an upright position when said ring and auxiliary frame are in their transport positions.

17. An apparatus according to claim 16 wherein said jack means are hydraulic jacks secured to said ring and operatively engage the foundation when raising or lowering the ring.

18. An apparatus according to claim 16 wherein said jack means are hydraulic jacks connected between said lower works and said ring for raising and lowering said ring.

19. An apparatus according to claims 10 or 16 wherein the distance between the lower surface of said ring and the lower surface of said ground engaging transport means defines the road clearance when the auxiliary frame means is in its transport position.

20. An apparatus according to claim 1 and additionally comprising mechanical locking means carried by said crane and movable into position between said auxiliary frame and said mounting means for supporting said auxiliary frame directly from said mounting means when said auxiliary frame is in its transport position.

21. An apparatus according to claim 20 wherein said locking means are supported for rotation by said auxiliary frame means and are rotated between inoperative positions and locking positions between said auxiliary frame and said mounting means and additionally comprising means for releasably securing said locking means to said mounting means adjacent each of said jack means when in their locking positions.

22. A heavy duty self-propelled mobile crane for use at a working site having a generally horizontal support surface; said crane including a chassis with ground engaging transport means, auxiliary frame means connected to said chassis for rotation about a vertical axis and having diametrically opposed end portions, article handling means primarily supported by one end of said frame and adapted to have a heavy article connected thereto for movement to a different location, counterweight means carried by the other end of the frame, and rotation supporting means operatively connected to the end portions of said frame for supporting said frame for rotation about said vertical axis when in a working position; the improvement which comprises means connecting said frame to said chassis for vertical movement relative thereto between said working position and a transport position, and power means operatively connected to said frame for changing the elevation of said frame and the components that are mounted for vertical movement therewith between elevations wherein the lowermost of said vertically movable components is either at said working position or at a position spaced above the ground a sufficient distance for providing adequate road clearance.

23. An apparatus according to claim 22 wherein said rotation supporting means comprises a thin steel ring which is attached to said horizontal supporting surface at said site, and roller means journalled on said frame and riding upon said ring when said frame is in its working position, said roller means defining said lowermost component.

24. An apparatus according to claim 22 wherein said rotation supporting means comprises a thick, full depth fabricated steel ring having a flat upper surface and a flat lower surface, and roller means operatively connected between said frame and said upper surface of said ring, said ring defining said lowermost components and said lowermost surface of said ring contacting said generally horizontal support surface at said working site when the components are in their working position, and being spaced above said surface to define said road clearance when the components are in their transport position.

25. An apparatus according to claim 22 wherein said power operated means for raising and lowering said auxiliary frame comprises a plurality of hydraulic jacks operatively connected between said lower works and said auxiliary frame means.

26. A heavy duty crane which includes a self propelled mobile lower works and means defining mobile crane components connected to said lower works for transportation therewith; said crane components including auxiliary frame means supported by said lower works for rotation about a vertical axis, article handling means primarily supported by one end of said frame means and adapted to have a heavy article attached thereto, counterweight means supported by the other end of said frame means, and roller means supported by said frame means at both ends thereof and adapted to roll upon means defining a hard rigid annular surface supported by the ground during operation of the crane at a construction site; the improvement which comprises power operated means for raising said mobile components to a transport position spaced a sufficient distance above the ground to provide adequate road clearance and for lowering said auxiliary frame and components attached thereto into a working position with said rollers on said annular surface for rotary movement about said vertical axis during an article handling operation.

27. An apparatus according to claim 26 wherein said hard, rigid surface is the upper surface of a steel ring supported by a horizontal concrete foundation when said frame means is in its working position.

28. An apparatus according to claim 27 wherein said steel ring is a fabricated circular ring of generally rectangular cross-section and is included in said mobile crane components.

29. An apparatus according to claim 28 wherein said fabricated steel ring includes front and rear portions and arcuate side portions, and additionally comprising means pivotally connecting said arcuate side portions to said front and rear portions for movement between a horizontal working position and a substantially vertical transport position, and means for selectively locking said arcuate side portions in either of said positions.

30. An apparatus according to claim 26 wherein said lower works and mobile component means when in said transport position are driven over a portion of said hard rigid surface, and wherein said auxiliary frame and components supported thereby are lowered into working position to place the roller means on said surface when said surface is centered with said vertical axis.

31. An apparatus according to claims 30 or 29 wherein said auxiliary frame is long and narrow having a width only slightly wider than said lower works when in the transport position.

32. An apparatus according to claim 26 wherein said hard rigid annular surface is the upper surface of a circular steel ring and wherein said steel ring includes a flat annular lower surface resting on a rigid ground supported surface when in said working position.

33. An apparatus according to claim 32 wherein said steel ring is of rigid construction, is concentric with said vertical axis and is maintained in a generally horizontal attitude when in both its working position and its transport position.

34. An apparatus according to claims 32 or 28 wherein said power operated means for raising and lowering said auxiliary frame means comprises a plurality of hydraulic jacks operatively connected between said fabricated circular steel ring and said ground supported surface for raising and lowering said ring and the auxiliary frame supported thereon, and means for latching said ring to said lower works when in said transport position to permit raising said jacks off said ground supported surface.

35. A heavy duty self-propelled mobile crane for use at one or more working sites; said crane having a chassis, a ground engaging transport means supporting said chassis for movement along the ground; means defining mobile crane components including a narrow auxiliary frame means connected to said chassis for rotation about a vertical axis relative thereto and having a width approximately the same as said transport means, article handling means primarily supported by one end of said frame and adapted to be connected to a heavy article, counterweight means carried by the other end of said frame, and roller means operatively connected to the end portions of said frame for supporting said frame for rotation about said vertical axis; the improvement which comprises power operated means for raising and lowering said auxiliary frame and mobile components operatively connected thereto between a load supporting work position adjacent the ground for support by said roller means, and a transport position supported by said chassis with the roller means spaced above the ground a distance sufficient to provide adequate road clearance; said roller means when in working position adapted to be positioned in rolling engagement with a hard, rigid horizontal ground support surface at a site concentric with said vertical axis.

36. An apparatus according to claim 35 wherein said ground engaging transport means is driven over a portion of said hard rigid horizontal ground support surface into centered position with said ring when said frame is in its transport position, said frame means then being lowered to place the roller means in working position on said hard rigid surface.

37. An apparatus according to claim 35 or 36 wherein said hard, rigid surface is the upper surface of a relatively thin steel ring connected to a concrete foundation of sufficient size to maintain the ring in substantially horizontal position when supporting heavy articles.

38. An apparatus according to claim 35 wherein said crane includes a hydraulic system and hydraulic controls, and wherein said power means comprises a plurality of hydraulic rams operatively connected between said chassis and said frame when the longitudinal axes of said chassis and frame are parallel for raising and lowering said frame.

39. An apparatus according to claim 38 wherein said hydraulic rams are secured to said chassis, wherein two of said hydraulic rams are positioned forwardly of said ground engaging transport means and two of said rams are positioned rearwardly of said transport means, said rams being widely spaced and positioned to operatively engage and raise said frame to said transport position when said frame is parallel to said support means and to be lowered out of engagement with said frame when in said working position.

40. An apparatus according to claim 39 and additionally comprising mechanical locking means carried by said crane and movable into position between said auxiliary frame and said chassis adjacent said rams for supporting said auxiliary frame directly from said chassis when said auxiliary frame is in its transport position.

41. An apparatus according to claims 38 or 40 wherein said hydraulic rams are effective to raise and lower said auxiliary frame through a range up to about 18 inches between said working position and said transport position.

42. An apparatus acording to claim 40 wherein said locking means are supported for rotation by said auxiliary frame means and are rotated between inoperative positions and operative locking positions between said auxiliary frame and said chassis, and additionally comprising means for releasably securing said locking means to said chassis when in their locking positions.

43. An apparatus according to claim 35 wherein said frame comprises end portions, elongated side portions rigidly connected to said end portions; said roller means each comprises a pivot bar, a pair of rollers journaled on each pivot bar, a leg secured to an associated end portion and pivotally connected to an intermediate portion of an associated pivot bar, each of said legs being of sufficient length to support said elongated side portions of said frame above said transport means a sufficient distance to permit rotation of said frame about said axis when said rollers are supported by said hard rigid surface.

44. An apparatus according to claim 35 wherein said power means is effective to raise and lower said auxiliary frame through a range up to about 18 inches between said working position and said transport position.

45. A heavy duty self-propelled mobile crane for use at a working site having a generally horizontal surface; said crane including a chassis with ground engaging transport means, auxiliary frame means connected to said chassis for rotation about a vertical axis, article handling means primarily supported by one end of said frame means and adapted to have a heavy article connected thereto for movement to a different location, counterweight means carried by the other end of said frame means, roller means operatively connected to the end portions of said frame means for supporting said frame means for rotation about said vertical axis, and a large diameter fabricated ring having a flat upper annular surface for rotatably supporting said rollers and a flat lower annular surface; the improvement which comprises means connecting said frame means to said chassis for vertical movement relative thereto, ring support means for connecting said ring to said chassis in a position concentric with said axis and for vertical movement relative to said chassis, power means operatively connected to said ring for changing the elevation of said ring and frame means supported thereby between a position wherein said lower annular surface engages said generally horizontal surface and a position spaced above the ground a sufficient distance for providing adequate road clearance, and means for coupling said ring to said chassis through said ring support means when in both said working position and said transport position.

46. An appartaus according to claim 45 wherein said ring is of rigid construction, is concentric with said vertical axis and is maintained in a generally horizontal attitude when in both its working position and its transport position.

47. An apparatus according to claim 45 wherein said fabricated steel ring includes front and rear portions and arcuate side portions, and additionally comprising means for pivotally connecting said arcuate side portions to said front and rear portions for movement between a horizontal working position and a substantially vertical transport position, and means for selectively locking said arcuate side portions in either of said positions.

48. An apparatus according to claim 45 wherein said power means includes a plurality of hydraulic jacks supported by said ring and operatively engaging said working site surface for changing the location of said ring between said transport position and said working position.

49. An apparatus according to claim 45 wherein said power means includes a plurality of hydraulic jacks operatively connected between said ring support means and said ring for moving said ring between said transport position and said working position.

50. In combination with a crane having a chassis with ground engaging propelling members and having a boom supporting frame rotatable about a vertical axis with respect to said chassis, a bed mounted on the ground to receive said frame in supporting engagement, the improvement comprising roller means interposed between said frame and said bed, and jacks connected between the chassis and the frame to lower and raise the frame with respect to said chassis and bed selectively for support of the rotatable frame by said roller means on the bed when the frame is lowered and for lifting the frame from the bed to clear the bed when the crane is moved onto or from the bed, said ground engaging propelling members remaining supported on said bed while the frame is being raised and lowered.

51. In combination with a crane having a chassis with ground engaging propelling members and having a boom supporting frame rotatable with respect to said chassis, the improvement comprising a bed mounted on the ground scaleable by said propelling members, means to lower and raise the frame with respect to said bed selectively for support of the rotatable frame by the bed and for lifting the frame to clear the bed when the crane is moved from the bed, and rollers between the bed and the frame for support through the rollers of the frame by the bed and for rotation through the rollers of the frame on the bed.

52. In combination with a crane having ground engaging propelling members and having a boom-supporting frame rotatable with respect to said propelling members, said frame having rollers depending therefrom, the improvement comprising a bed mounted on the ground scaleable by said propelling members, and means to lower and raise the frame with respect to said propelling members selectively to engage said rollers with the bed for support and rotation of the frame on the bed and to disengage said rollers from said bed for movement of the crane from the bed.

53. In combination with a crane having a chassis with ground engaging propelling members and having a boom-supporting frame, said crane having means to rotate said frame about a vertical axis through said chassis, and said frame having rollers depending therefrom, the improvement comprising a bed mounted on the ground scaleable by said propelling members, and means on the chassis to lower and raise the frame with respect to said chassis selectively to engage said rollers with the bed for support and rotation of the frame on the bed and to disengage said rollers from the bed.

54. In combination with a crane having a lower works with ground engaging propelling members and having an upper works for powered rotation about a vertical axis on the lower works, said crane having a boom-supporting frame with rollers thereon and having means to rotate said frame with said upper works about said vertical axis, the improvement comprising a bed mounted on the ground and including a ring, said bed and ring scaleable by the propelling members of the crane for movement of the crane inside the ring to a position where said vertical axis is centered with respect to the ring, and means on the lower works to lower and raise the frame relative to the lower works and to the ring but with the ground engaging propelling members remaining supported on the bed.

55. In a crane having a lower works with ground engaging propelling members and having an upper works; said crane having a boom-supporting frame rotatable about a vertical axis with respect to said chassis; a ring mountable on the ground to receive said frame in supporting engagement for rotation thereon; the improvement comprising roller means interposed between said frame and said ring; jack means connected between the ground and said ring for lowering and raising said ring, said roller means and said frame as a unit between a working position with the ring directly supported on the ground and a transport position with the ring spaced above the ground; means for locking said ring in said transport position allowing said jack means to be raised from the ground; and wherein said ring has at least four segments including a front segment, a rear segment, and two side segments, each of said segments hinged to the front and rear segments for movement between horizontal and upright positions, means to connect said front and rear segments to the chassis in horizontal orientation, and means to hold said hinged outer ring sections in the raised position for transport of the crane.

* * * * *